US009179815B2

(12) United States Patent
Davidshofer et al.

(10) Patent No.: US 9,179,815 B2
(45) Date of Patent: Nov. 10, 2015

(54) FLOOR MOP WITH REMOVABLE BASE PLATE

(71) Applicant: Electrolux Home Care Products, Inc., Charlotte, NC (US)

(72) Inventors: Donald Joseph Davidshofer, Mount Holly, NC (US); Saba Rizzi, Charlotte, NC (US); Jamie Star Perin, Charlotte, NC (US)

(73) Assignee: Electrolux Home Care Products, Inc., Charlotte, NC (US)

( * ) Notice: Subject to any disclaimer, the term of this patent is extended or adjusted under 35 U.S.C. 154(b) by 83 days.

(21) Appl. No.: 14/043,346

(22) Filed: Oct. 1, 2013

(65) Prior Publication Data

US 2015/0089757 A1 Apr. 2, 2015

(51) Int. Cl.
*A47L 13/24* (2006.01)
*A47L 13/254* (2006.01)

(52) U.S. Cl.
CPC ..... *A47L 13/254* (2013.01)

(58) Field of Classification Search
CPC ..... A47L 13/254; A47L 13/24
USPC ..... 15/147.1, 147.2, 228
See application file for complete search history.

(56) References Cited

U.S. PATENT DOCUMENTS

| | | | |
|---|---|---|---|
| 1,563,829 | A | 12/1925 | Brown |
| 2,205,535 | A | 6/1940 | Muckenhirn |
| 2,310,011 | A | 2/1943 | Cave et al. |
| 2,469,060 | A | 5/1949 | Vosbikian et al. |
| 2,678,458 | A | 5/1954 | Vosbikian et al. |
| 2,764,774 | A | 10/1956 | Belsky et al. |
| 2,804,638 | A | 9/1957 | Vosbikian et al. |
| 3,006,668 | A | 10/1961 | Stewart |
| 3,050,762 | A | 8/1962 | Ballinger |
| 3,362,037 | A | 1/1968 | Griffin |
| 3,395,415 | A | 8/1968 | Leland |
| 3,440,677 | A | 4/1969 | Flomerfelt |

(Continued)

FOREIGN PATENT DOCUMENTS

| | | | |
|---|---|---|---|
| DE | 19908259 | 8/2000 | |
| EP | 0426209 A1 * | 5/1991 | ..... A47L 13/258 |

(Continued)

OTHER PUBLICATIONS

Entire patent prosecution history of U.S. Appl. No. 13/833,571, filed Mar. 15, 2013, entitled, "Steam Distribution Apparatus and Methods for Steam Cleaning Devices."

(Continued)

*Primary Examiner* — Laura C Guidotti
(74) *Attorney, Agent, or Firm* — RatnerPrestia

(57) ABSTRACT

A mop having a base plate, a top plate, a handle, and a lock assembly to connect the top plate to the base plate. The base plate has a lower surface configured to face a surface to be cleaned, and an upper surface opposite the lower surface. The handle has a proximal end connected to the top plate by a joint, and a distal with a grip at the distal end. The lock assembly includes one or more slots on one of the base plate and the top plate, and one or more projections on the other of the base plate and the top plate. The one or more projections are movable between an engaged position in which the one or more projections are in the one or more slots, and a disengaged position in which the one or more projections are not in the one or more slots.

20 Claims, 3 Drawing Sheets

(56) References Cited

U.S. PATENT DOCUMENTS

| | | | | |
|---|---|---|---|---|
| 3,656,202 | A | | 4/1972 | Paton |
| 3,720,974 | A | | 3/1973 | Rosendall |
| 3,792,505 | A | * | 2/1974 | Saltzstein ..... 15/231 |
| 3,850,533 | A | | 11/1974 | Thielen |
| 4,031,673 | A | | 6/1977 | Hagelberg |
| 4,068,340 | A | | 1/1978 | Forward |
| 4,127,911 | A | * | 12/1978 | Cupp et al. ..... 15/210.1 |
| 4,165,550 | A | | 8/1979 | Birke |
| 4,219,899 | A | | 9/1980 | Zurawin et al. |
| 4,299,262 | A | | 11/1981 | Andrepont |
| 4,327,459 | A | | 5/1982 | Gilbert |
| 4,392,269 | A | | 7/1983 | Nishiyama et al. |
| 4,433,451 | A | | 2/1984 | Parisi |
| 4,658,461 | A | | 4/1987 | Roe et al. |
| 4,845,800 | A | | 7/1989 | Pederson et al. |
| 4,858,962 | A | | 8/1989 | Bolling |
| 4,864,675 | A | | 9/1989 | Jones |
| 4,926,515 | A | | 5/1990 | Lynn et al. |
| 5,067,400 | A | | 11/1991 | Bezella et al. |
| 5,133,101 | A | | 7/1992 | Hauser et al. |
| 5,232,298 | A | | 8/1993 | Mitsunari |
| 5,323,506 | A | * | 6/1994 | Babitch ..... 15/210.1 |
| 5,341,541 | A | | 8/1994 | Sham |
| 5,377,378 | A | | 1/1995 | Cutler |
| 5,386,612 | A | | 2/1995 | Sham |
| 5,502,872 | A | | 4/1996 | Chae |
| 5,581,839 | A | | 12/1996 | Ferrell, Jr. |
| 5,584,091 | A | | 12/1996 | Borofsky |
| 5,591,507 | A | | 1/1997 | Jones |
| 5,613,271 | A | | 3/1997 | Thomas |
| 5,625,918 | A | | 5/1997 | Kieson et al. |
| 5,876,141 | A | | 3/1999 | Hsu |
| 5,881,423 | A | | 3/1999 | Shumway et al. |
| 5,887,314 | A | | 3/1999 | Jordan, Jr. |
| 5,888,006 | A | | 3/1999 | Ping |
| 5,901,402 | A | | 5/1999 | Williams |
| 5,920,952 | A | | 7/1999 | Baldacci |
| 5,988,920 | A | | 11/1999 | Kunkler et al. |
| 6,003,191 | A | | 12/1999 | Sherry et al. |
| 6,087,279 | A | | 7/2000 | Laun |
| 6,101,661 | A | | 8/2000 | Policicchio et al. |
| 6,119,298 | A | | 9/2000 | Kenmochi |
| 6,148,144 | A | | 11/2000 | Milanese |
| 6,289,551 | B1 | | 9/2001 | Basile |
| 6,305,046 | B1 | | 10/2001 | Kingry et al. |
| 6,336,240 | B1 | | 1/2002 | Laux et al. |
| 6,397,427 | B1 | | 6/2002 | Bryngelsson |
| 6,453,506 | B1 | | 9/2002 | Sumner |
| 6,463,620 | B2 | | 10/2002 | Busha |
| 6,487,746 | B1 | | 12/2002 | Cioci |
| 6,502,275 | B1 | | 1/2003 | Hsieh |
| 6,540,424 | B1 | | 4/2003 | Hall et al. |
| 6,546,584 | B2 | | 4/2003 | Hobden |
| 6,571,421 | B1 | | 6/2003 | Sham et al. |
| 6,579,023 | B2 | | 6/2003 | Kunkler |
| 6,584,990 | B2 | | 7/2003 | Shaw |
| 6,591,442 | B2 | | 7/2003 | Kaminstein |
| 6,606,757 | B2 | | 8/2003 | Vosbikian et al. |
| 6,640,383 | B2 | | 11/2003 | Tsen |
| 6,663,306 | B2 | | 12/2003 | Policicchio |
| 6,669,391 | B2 | | 12/2003 | Policicchio |
| 6,692,172 | B1 | | 2/2004 | Hsu |
| 6,716,805 | B1 | | 4/2004 | Sherry et al. |
| 6,722,806 | B2 | | 4/2004 | Kunkler |
| 6,814,519 | B2 | | 11/2004 | Policicchio |
| 6,820,301 | B2 | | 11/2004 | Petner |
| 6,823,559 | B2 | | 11/2004 | Kaffenberger |
| 6,836,921 | B1 | | 1/2005 | Petner |
| 6,842,936 | B2 | | 1/2005 | Policicchio et al. |
| 6,854,911 | B2 | | 2/2005 | Policicchio |
| 6,871,372 | B2 | | 3/2005 | Vosbikian et al. |
| 6,889,917 | B2 | | 5/2005 | Fahy et al. |
| 6,892,415 | B2 | | 5/2005 | Libman et al. |
| 6,893,180 | B2 | | 5/2005 | Hall |
| 6,899,485 | B2 | | 5/2005 | Hall |
| 6,910,823 | B2 | | 6/2005 | Policicchio |
| 6,934,995 | B2 | | 8/2005 | Wheeler |
| 6,948,873 | B2 | | 9/2005 | Policicchio |
| 6,953,299 | B2 | | 10/2005 | Wang et al. |
| 6,964,535 | B2 | | 11/2005 | Bell |
| 6,976,802 | B2 | | 12/2005 | Hall |
| 6,986,618 | B2 | | 1/2006 | Hall |
| 6,990,708 | B2 | | 1/2006 | Rosa |
| 7,007,338 | B2 | | 3/2006 | Garabedian, Jr. et al. |
| 7,028,364 | B2 | | 4/2006 | Policicchio |
| 7,033,965 | B2 | | 4/2006 | Takabayashi et al. |
| 7,048,804 | B2 | | 5/2006 | Kisela |
| 7,055,204 | B2 | | 6/2006 | Ajluni |
| 7,059,011 | B2 | | 6/2006 | Capitani |
| 7,096,531 | B2 | | 8/2006 | Policicchio |
| 7,124,464 | B2 | | 10/2006 | Williams et al. |
| 7,127,772 | B2 | | 10/2006 | Dingert et al. |
| 7,137,169 | B2 | | 11/2006 | Murphy |
| 7,144,173 | B2 | | 12/2006 | Policicchio |
| 7,163,349 | B2 | | 1/2007 | Policicchio |
| 7,182,537 | B2 | | 2/2007 | Policicchio |
| 7,185,392 | B2 | | 3/2007 | Murray |
| 7,225,495 | B2 | | 6/2007 | Berti et al. |
| 7,264,413 | B2 | | 9/2007 | Vosbikian et al. |
| 7,293,322 | B2 | | 11/2007 | Matousek |
| 7,313,843 | B2 | | 1/2008 | Brinker et al. |
| 7,343,638 | B2 | | 3/2008 | Mitchell et al. |
| 7,350,257 | B2 | | 4/2008 | McKay |
| 7,380,307 | B2 | | 6/2008 | Tsai |
| 7,428,768 | B2 | | 9/2008 | Bingert |
| 7,465,115 | B2 | | 12/2008 | Suda |
| 7,536,743 | B2 | | 5/2009 | Goh et al. |
| 7,566,671 | B2 | | 7/2009 | Hoadley |
| 7,574,768 | B2 | | 8/2009 | Morris et al. |
| 7,618,206 | B2 | | 11/2009 | Sacks |
| 7,640,626 | B2 | | 1/2010 | Oh |
| 7,648,303 | B2 | | 1/2010 | Zorzo |
| 7,665,180 | B2 | | 2/2010 | Haan |
| 7,699,551 | B2 | | 4/2010 | Suda |
| 7,721,381 | B2 | | 5/2010 | Michelson et al. |
| 7,740,193 | B2 | | 6/2010 | Soller et al. |
| 7,779,501 | B2 | | 8/2010 | Lacotta et al. |
| 7,841,039 | B1 | | 11/2010 | Squire |
| 7,841,040 | B2 | | 11/2010 | Strunk et al. |
| 7,856,691 | B2 | | 12/2010 | Viggiani |
| 7,891,047 | B2 | | 2/2011 | Milanese |
| 7,895,697 | B2 | | 3/2011 | Cassar |
| 7,930,798 | B2 | | 4/2011 | Zhou |
| 8,052,342 | B2 | | 11/2011 | Rosenzweig |
| 8,056,181 | B2 | | 11/2011 | Kim |
| 8,069,520 | B2 | | 12/2011 | Mattucci et al. |
| 8,142,094 | B2 | | 3/2012 | Kaleta et al. |
| 8,166,597 | B2 | | 5/2012 | Levitt et al. |
| 8,171,592 | B2 | | 5/2012 | Tsai |
| 8,186,898 | B2 | | 5/2012 | Bradbury |
| 8,205,288 | B2 | | 6/2012 | Broman et al. |
| 8,205,293 | B2 | | 6/2012 | Rosenzweig |
| 8,239,999 | B2 | | 8/2012 | Hsu |
| 8,245,351 | B2 | | 8/2012 | Rosenzweig |
| 8,250,700 | B2 | | 8/2012 | Pung et al. |
| 8,261,402 | B2 | | 9/2012 | Rosenzweig |
| 8,267,607 | B2 | | 9/2012 | Harris |
| 8,276,234 | B2 | | 10/2012 | Hsu |
| 8,286,294 | B2 | | 10/2012 | Cassar |
| 8,407,848 | B2 | | 4/2013 | Pung et al. |
| 8,449,682 | B2 | | 5/2013 | Perelli et al. |
| 8,464,389 | B2 | | 6/2013 | Jiang et al. |
| 8,464,391 | B2 | | 6/2013 | Bober et al. |
| 2002/0194693 | A1 | | 12/2002 | Wu |
| 2003/0028988 | A1 | | 2/2003 | Streutker et al. |
| 2003/0044569 | A1 | | 3/2003 | Kacher et al. |
| 2003/0126710 | A1 | | 7/2003 | Policicchio |
| 2004/0146332 | A1 | | 7/2004 | Fu |
| 2004/0231700 | A1 | | 11/2004 | Bell et al. |
| 2007/0130713 | A1 | | 6/2007 | Chen et al. |
| 2008/0222825 | A1 | | 9/2008 | Sampaio |
| 2009/0235476 | A1 | | 9/2009 | Cioci |
| 2009/0249570 | A1 | | 10/2009 | Rosenzweig et al. |
| 2010/0199455 | A1 | | 8/2010 | Vrdoljak |

(56) References Cited

U.S. PATENT DOCUMENTS

| | | | |
|---|---|---|---|
| 2011/0167583 | A1 | 7/2011 | Weaver et al. |
| 2011/0185529 | A1 | 8/2011 | Kandasamy et al. |
| 2011/0219581 | A1 | 9/2011 | Vines |
| 2011/0223375 | A1 | 9/2011 | Kaminer |
| 2012/0195674 | A1 | 8/2012 | Mandle et al. |
| 2012/0269567 | A1 | 10/2012 | Crawford et al. |
| 2013/0067673 | A1 | 3/2013 | Yu |

FOREIGN PATENT DOCUMENTS

| | | |
|---|---|---|
| EP | 0430846 | 6/1991 |
| EP | 1985221 | 10/2008 |
| GB | 2276811 | 10/1994 |
| WO | WO9740736 | 11/1997 |

OTHER PUBLICATIONS

Entire patent prosecution history of U.S. Appl. No. 14/035,431, filed Sep. 24, 2013, entitled, "Flexible Scrubbing Head for a Floor Mop."
Entire patent prosecution history of U.S. Appl. No. 14/035,455, filed Sep. 24, 2013, entitled, "Sliding Scrub Brush for a Floor Mop."
Entire patent prosecution history of U.S. Appl. No. 14/035,472, filed Sep. 24, 2013, entitled, "Floor Mop With Concentrated Cleaning Feature."
Photographs of Dirt Devil Products publicly available before Sep. 24, 2013, 6 pages.
Notice of Allowance mailed Jun. 8, 2015 for U.S. Appl. No. 13/833,571.
Office Action mailed Jan. 16, 2015 for U.S. Appl. No. 13/833,571.
Office Action mailed Mar. 11, 2015 for U.S. Appl. No. 14/035,455.

* cited by examiner

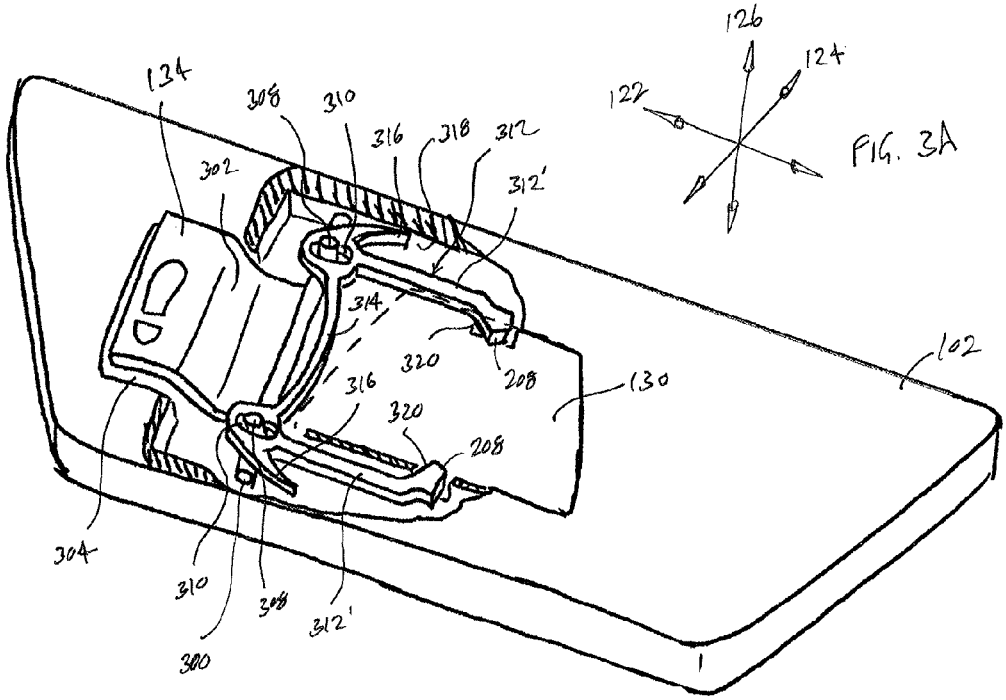
FIG. 3A
FIG. 3B
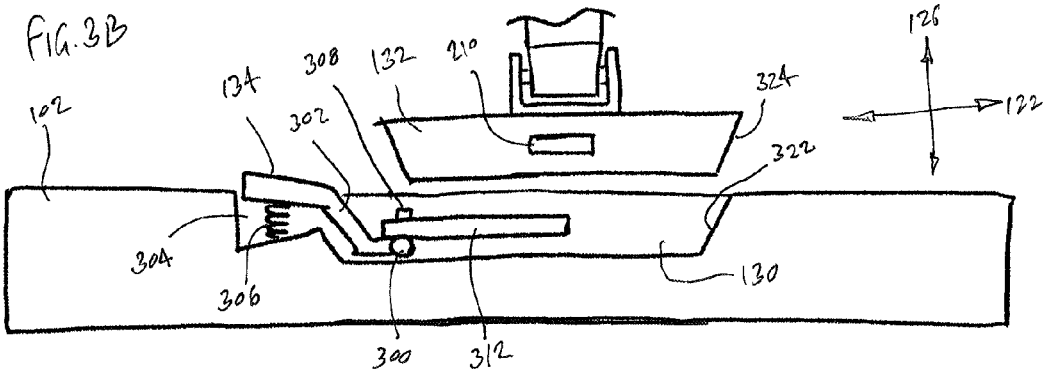
FIG. 3C
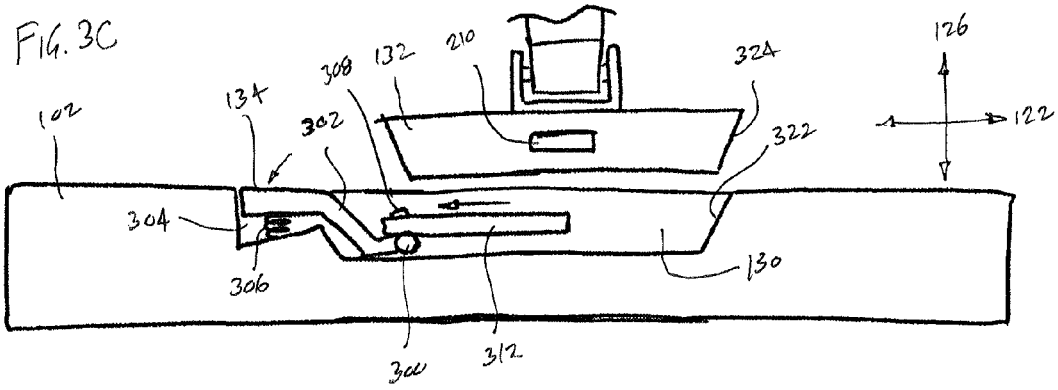

FLOOR MOP WITH REMOVABLE BASE PLATE

CROSS-REFERENCE TO RELATED APPLICATIONS

The present application is related to U.S. patent application Ser. Nos. 14/035,431; 14/035,455; and 14/035,472, which are incorporated herein by reference.

FIELD OF THE INVENTION

The present invention relates to floor mops, and more particularly to floor mops having a removable base plate feature.

BACKGROUND

Spray Mops are simple cleaning tools that have gained favor by consumers following a recent trend in the popularity of hard floor surfaces (e.g., tile, wood, stone, marble, linoleum etc.) within the housing market. Early hard floor cleaning tools typically comprised a string mop, rag mop, or sponge mop that was used in conjunction with a separate bucket of cleaning solution. Such devices are still in use today, and can be effective, but they are often considered cumbersome to use.

The foregoing mopping devices have been replaced in the marketplace with increasing frequency by flat mops having a flat plate mounted to a long handle, with a removable cleaning pad attached to the plate. Such cleaning pads have included traditional woven fabrics (e.g., string or a knit fabric), sponges, nonwoven fabrics made of polymers, wood pulp, and the like. Woven and sponge mop pads are generally considered to be reusable, whereas nonwoven pads are often considered to be "disposable" because they are difficult or impossible to effectively clean for multiple reuses.

Flat mops may be used with a separate supply of cleaning fluid (water, detergent or the like), but some are equipped as a "spray mop" having a built-in fluid deposition system including a spray nozzle attached either to the plate or the handle, a vessel filled with liquid cleaning fluid, and mechanism to control the flow of cleaning fluid. Such mechanisms have included, among other things, manually- and electrically-operated pumps, and gravity-operated systems controlled by a valve. The spray frequency and duration are controlled by the user using a hand trigger located on or close to the handle grip. Once the vessel is filled with the cleaning solution of choice and the cleaning pad is installed, the user places the plate on the target surface (typically a floor) and energizes the spray system by squeezing the hand trigger or other mechanism to wet the surface. Once the surface is wetted, the user moves the spray mop pad across the wet surface in forward/aft or left/right directions to wick up the cleaning solution, and applies a light downward force to transfer the dirt from the floor to the (now wet) pad.

The plate of a flat mop typically has a large surface (e.g., ~400 mm wide×~100 mm deep). The large surface area provided by the plate and underlying pad provides a large cleaning path, which reduces the time required to clean large areas and provides a significant transfer surface to pick up dirt and liquid. Often, much of the floor area covered by a typical flat mop is large spans of non-obstructed space (e.g., a living room, a hallway, a kitchen area, etc.). However, it is frequently the case that the flat plate is too large to access areas that are obstructed, such as spaces between furniture, under tables, corners and the like. This poses a problem to the user, which is often resolved by either omitting those areas or cleaning those areas by hand. Additionally, there are times when the user does not want to use the same mop pad in multiple rooms. Users often resolved this problem by using two separate spray mops or by changing pads.

There exists a need to provide alternative solutions to the problems of cleaning obstructed floor space using flat mops, spray mops, and the like.

SUMMARY

In one exemplary embodiment, there is provided a mop having a base plate, a top plate and a handle. The base plate has a generally flat lower surface configured to face a surface to be cleaned, and an upper surface opposite the lower surface. The handle has a proximal end, a distal end opposite the proximal end, and a handle axis extending from the proximal end to the distal end. A joint connects the proximal end of the handle to the top plate, and a grip is located at the distal end of the handle. A lock assembly is also provided. The lock assembly is configured to selectively connect the top plate to the upper surface of the base plate. The locking assembly includes one or more slots on one of the base plate and the top plate, and one or more projections on the other of the base plate and the top plate. The one or more projections are movable between an engaged position in which the one or more projections are in the one or more slots, and a disengaged position in which the one or more projections are not in the one or more slots.

It will be appreciated that this Summary is not intended to limit the claimed invention in any way.

BRIEF DESCRIPTION OF THE DRAWINGS

A better understanding of the exemplary embodiments may be understood by reference to the attached drawings, in which like reference numbers designate like parts. The drawings are exemplary, and not intended to limit the claims in any way.

FIG. 3A is an isometric view of a base plate with portions shown transparent to illustrate the underlying structure.

FIGS. 3B and 3C are cross-sectional schematic side views of the base plate of FIG. 3A, showing certain parts in different operative positions.

BRIEF DESCRIPTION OF EMBODIMENTS

The inventors have developed new apparatus and methods for cleaning obstructed floor space using a flat mop or spray mop. Non-limiting examples of these apparatus and methods are described below. The following embodiments generally describe the inventions in the context of a spray mop, but it will be readily apparent that these embodiments are also applicable to flat mops that do not have a separate liquid depositing system.

Figure 1B:
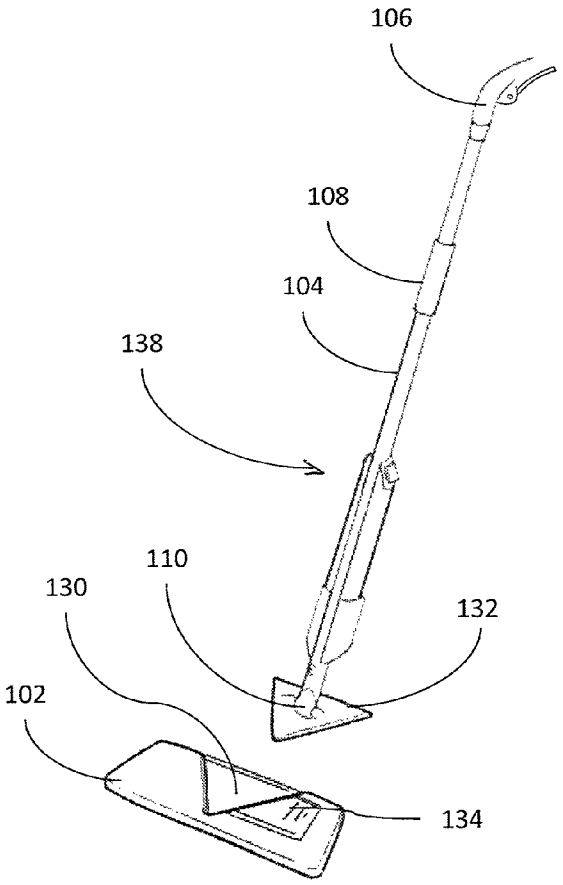
FIG. 1B is an isometric front view of the spray mop of FIG. 1, shown in a second configuration.
Figure 1A:
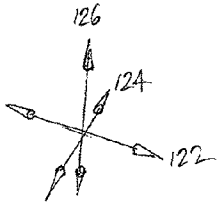
FIG. 1A is an isometric front view of an exemplary embodiment of a spray mop according to aspects of the invention, shown in a first configuration.
Figure 1A:
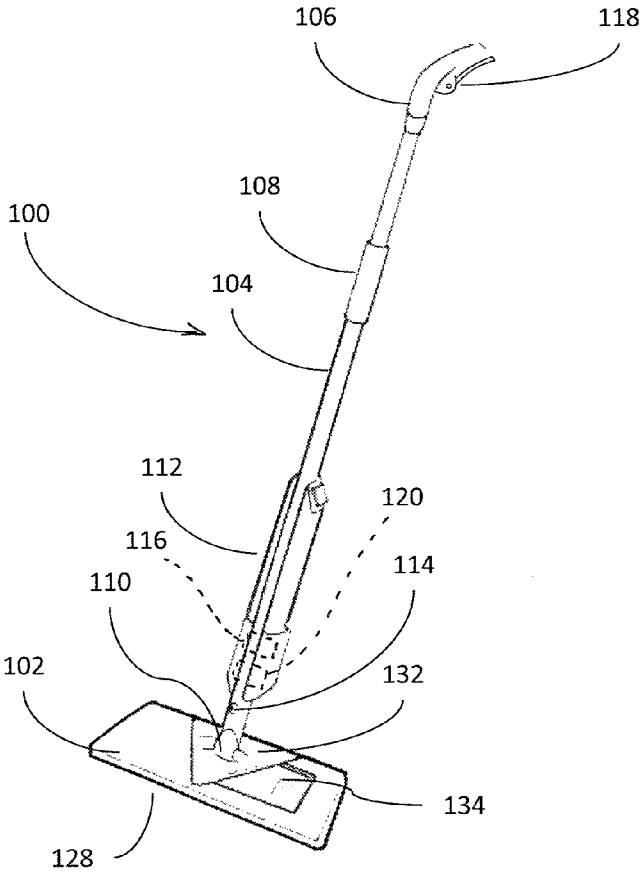

FIGS. 1A and 1B illustrate an exemplary embodiment of a spray mop 100 that is adapted for cleaning obstructed floor space. As used herein, the term "obstructed floor space" is intended to have its broad colloquial meaning, and includes floor space having obstructions (i.e., furniture, electronics, beams, etc.) or other physical interferences making it difficult for ordinary spray mops with larger surface areas to clean the floor space.

The exemplary spray mop 100 includes a base plate 102 to which a handle 104 is attached via a top plate 132 and connection port 130. The handle 104 is attached at a proximal (lower) end to the top plate 132, and includes first grip 106 at a distal (upper) end, and a second grip 108 at a location between the proximal and distal ends of the handle 104. The first grip 106 and the second grip 108 may be contoured or have gripping material (e.g., overmolded rubber, etc.) to facilitate the user's operation of the mop 100.

The handle 104 is connected to a top side of the top plate 132 by a joint 110. The joint 110 may be a rigid connection, but more preferably is a pivot joint. A pivot joint may be a single-axis pivot that allows the base plate 102 and/or top plate 132 and handle 104 to rotate relative to one another about a single axis, or a multiple-axis pivot that allows the base plate 102 and/or top plate 132 and handle 104 to rotate relative to one another about multiple (e.g., two) axes. Such pivot joints are known in the art, and an example of a suitable pivot joint is shown in U.S. Pat. No. 5,876,141, which is incorporated herein by reference.

The handle 104 may include a fluid deposition system for distributing cleaning fluid (water, detergent, etc.) onto the surface being cleaned. The fluid deposition system includes a tank 112 to hold the cleaning fluid, a sprayer 114 that is positioned and oriented to distribute the fluid in the desired direction, a pump and/or valve assembly 116 to control the fluid flow, and a trigger 118 that is operated by the user to activate the pump/valve assembly 116. The details of such fluid deposition systems are known in the art, and need not be described herein. Examples of suitable fluid deposition systems include, for example, those shown in U.S. Pat. Nos. 5,888,006; 6,659,670; 6,960,042; 6,692,172; 6,722,806; 7,004,658; 7,048,458; 7,160,044; 7,172,099; and 7,850,384, which are incorporated herein by reference. Without excluding other options, the inventors believe that the system shown in U.S. Pat. No. 6,960,042 is expected to be particularly useful to provide simple and effective fluid deposition. In this embodiment, the fluid deposition system comprises a pump 116 that is fluidly connected to the tank 112 to receive the cleaning fluid, and a sprayer 114 that is fluidly connected to the pump 116 to receive pressurized fluid and deposit the fluid onto the surface to be cleaned. Fluid connections may be made by hoses or rigid passages formed in the handle housing. The pump 116 may be a simple plunger pump that is operated by a trigger 118 located at the first grip 106 via a linkage that extends down the length of the handle 104. The tank 112 may be removable for refilling or replacement, or fixed and refilled in place. The foregoing features and variations are well-known in the art, and need not be described herein.

It will be appreciated that various modifications may be made to the foregoing embodiment. For example, the fluid deposition system may be omitted to provide a simple flat mop. As another example, the fluid deposition system may be modified by placing the sprayer 114 or other parts, such as the tank 112, on the base plate 102 and/or the top plate 132. As yet another example, a heater 120 may be added in the fluid lines (or to the tank 112) to heat the liquid and/or convert the liquid into steam prior to deposition on the surface being cleaned. As still another example, a vacuum system (i.e., a vacuum suction fan and motor, and associated dirt receptacle), may be added to the mop 100. An example of such a system is shown, in conjunction with an optional steam generator, in U.S. Pat. No. 6,571,421, which is incorporated herein by reference. Other variations and modifications will be apparent to persons of ordinary skill in the art in view of the present disclosure.

The base plate 102 comprises a generally flat base plate lower surface 128 that faces the floor or other surface during use. The base plate 102 may be rectangular, or have a trapezoidal shape (as shown), or have any other desirable shape desirable for cleaning relatively large open spaces. If desired, the lower surface 128 may have grooves or an arched shape to help distribute forces across the base plate 102, or other features that may be useful to enhance cleaning (e.g., steam outlets). The base plate 102 preferably is elongated in a lateral direction 122, and lies flat in a plane defined by the lateral direction 122 and a longitudinal direction 124 that is perpendicular to the lateral direction. When used on a flat floor or the like, the lateral and longitudinal directions 122, 124 will be perpendicular to a vertical direction 126 defined along the global vertical direction (i.e., the axis of gravitational pull).

As explained above, a common problem encountered with conventional base plates is that their large surface area prevents the mop from accessing and cleaning obstructed floor space. To address this problem, the base plate 102 is preferably configured to be removable from the top plate 132, so that the top plate 132 and handle 104 can be used as a separate converted cleaning device 138. The top plate 132 may be released from the base plate 102 by depressing a pedal 134 or operating another mechanism. Once released, the handle 104 and top plate 132 provide a converted mop 138 with the top plate 132 replacing the base plate 102 as the cleaning member.

Figure 2:
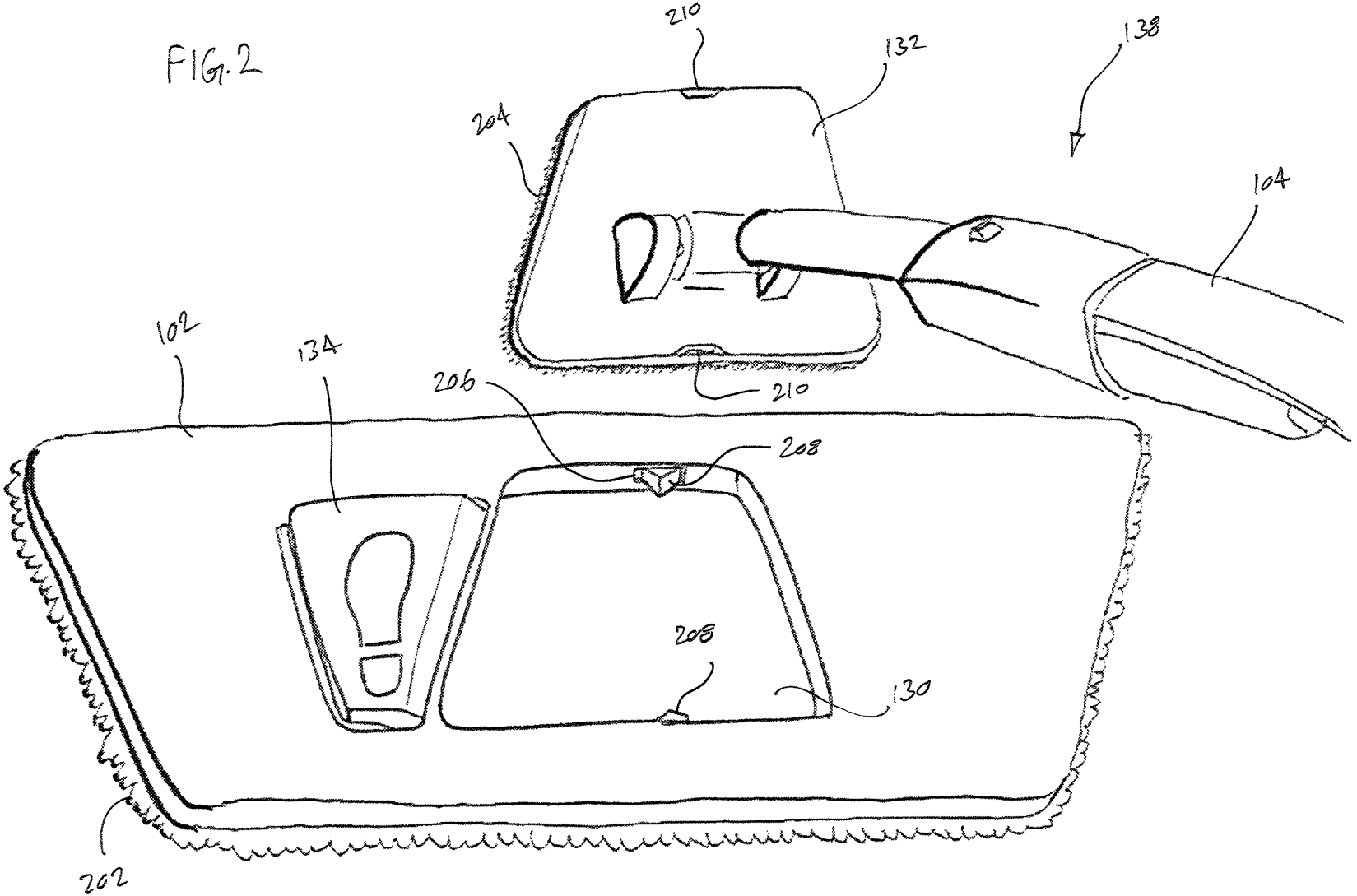
FIG. 2 is a top view of a base plate and converted mop.

The top plate 132 preferably has a smaller bottom surface area than the base plate 102, and may be shaped or configured to clean obstructed floor spaces. For example, in the embodiment of FIGS. 1A and 1B, the top plate 132 is substantially triangular to allow easy cleaning in tight corners (i.e., corners having an angle of less than 90°). As another example, the top plate 132 may comprise a trapezoid shape, such as the isosceles trapezoid shape shown in FIG. 2. The triangular shape in FIG. 1B and the trapezoid shape in FIG. 2 are both oriented with the apex or smaller end facing forward, but this orientation may be reversed. Other suitable geometries (e.g., crescent-shaped, V-shaped, ovoid, rectilinear, etc.) for the top plate 132 to clean obstructed floor space will be understood by one of skill in the art from the description herein, and such shapes may be modified in various embodiments to provide for general or specific cleaning needs.

The base plate 102 and/or the top plate 132 may include an integral cleaning member, such as permanently affixed bristles or the like. More preferably, the base plate 102 and top plate 132 each is equipped with a replaceable cleaning pad 202/204 (FIG. 2). The replaceable cleaning pads 202/204 may comprise a nonwoven material, a woven fabric, or any other suitable cleaning medium. The cleaning pads 202/204 may be connected to the base plate 102 and the top plate 132, respectively, by hook-and-loop fasteners, press-in fittings, wrapping portions of the pad 202 and 204 around the base plate 102 and the top plate 132, respectively, and so on. Non-limiting examples of pad materials and mechanisms for attaching the pad 202/204 to the base plate 102 and/or the top plate 132 are described in U.S. Pat. Nos. 4,031,673; 6,003,191; 6,305,046; 6,716,805; 6,692,172; 7,350,257; 7,721,381, and 8,464,391, which are incorporated herein by reference. In one exemplary embodiment, the pads 202/204 each comprise a reusable and washable pad comprising one or more woven fabric layers, and the tops of the pads 202/204 and bottoms of the base plate 102 and top plate 132 have complementary hook-and-loop fasteners that releasably connect the pads 202/

204 during use. The two pads 202/204 may have similar constructions, or they may have different constructions to provided different degrees or kinds of cleaning functions. For example, the cleaning pad 204 for the top plate 132 may comprise a coarser cleaning cloth than the cleaning pad 202 for the base plate 102.

In a preferred embodiment, the top plate 132 and its cleaning pad 204 are configured such that the top plate 132 can be mounted to the base plate 102 while the top plate's cleaning pad 204 is in place on the lower surface of the top plate 132.

As shown in FIG. 2, the base plate 102 may comprise a port 130 configured to house the top plate 132 such that the handle 104 and the top plate 132 (i.e., the converted mop 138) are detachably connected to the base plate 102. The port 130 may geometrically match the top plate 132, as shown. However, in other embodiments, the port 130 may be shaped to house a top plate 132 that has a different geometry. This latter embodiment may be desirable if a variety of top plates 132 having different shapes are available for use with a single base plate 102. Various geometries, both matching and non-matching, for top plates and ports suitable for the spray mop will be understood by one of skill in the art from the description herein. In addition, the port 130 may wrap around the entire perimeter of the top plate 132, such as shown, or it may surround only discrete portions of the top plate's perimeter. In order to provide a solid connection between the top plate 132 and the base plate 102 when a pad 204 is mounted to the top plate 132, the port 130 and top plate 132 may have interacting structural elements that provide solid contact at one or more locations around the perimeter of the top plate 132. For example, the perimeter wall 322 of the port 130 may be beveled, such as shown in FIGS. 3B and 3C, and the perimeter wall 324 of the top plate 132 may have a similar or matching bevel to firmly abut the beveled port 130 to provide a solid connection at this location, even when a pad 204 is mounted to the top plate 132.

The top plate 132 is retained in the port 130 by one or more projections 208 that detachably mate with slots 210 located around the perimeter of the top plate 132. The projections 208 slide into the slots 210 to prevent the top plate 132 from lifting out of the port 130. The top plate 132 is removed by retracting the projections 208 from the slots 210, such as described below. The locking mechanism that operates the projections 208 may be housed at least partially inside the base plate 208, in which case the projections 208 may extend through openings 206 located in or adjacent the port 130. To provide a simple and intuitive operation, the projections 208 may be operated by a pedal 134 located on the base plate 102.

Referring to FIGS. 3A, 3B and 3C, an example of an unlocking mechanism for removing the projections 208 from the slots 210 is shown and described. FIG. 3A shows the base plate 102 with certain areas removed or rendered transparent to help explain the structure. FIGS. 3B and 3C show schematic rear views of the base plate 102.

In the exemplary unlocking mechanism, the pedal 134 is connected to a pivot 300 by an arm 302. At least some of the arm 302 may be located within a hollow housing formed as part of the base plate 102, to conceal and protect the operative mechanisms. The pivot 300 pivotally connects the arm 302 and pedal 134 to the base plate 102, to allow rotation around a pedal axis. The pivot 300 may comprise cylindrical posts that are mounted in corresponding cylindrical bosses in the base plate 102, or other rotating connections known in the art. The base plate 102 may include a cavity 304 below the pedal 134 to allow a predetermined range of movement of the pedal 134 downward along the vertical axis 126. A spring 306 may be positioned in the cavity 304, and below the pedal 134, to bias the pedal 134 upwards when it is not being depressed by a user.

Disposed on the upper surface of the pivot 300 are one or more protrusions 308 extending upward with respect to the pivot 300 along the vertical axis 126. The protrusions 308 are rigidly connected to the arm 302 and pedal 134. Thus, the protrusions 308 rotate about the pedal axis as the pedal 134 is depressed by the user. The pedal 134, arm 302, and protrusions 308 may be formed as one integrally-formed piece, but alternatively may be formed as multiple joined pieces.

The protrusions 308 are configured to extend upwards through corresponding openings 310 in a lock member 312. The lock member 312 includes two arms 312' that extend laterally from the openings 310 and terminate at respective projections 208 that are used to lock the top plate 132 in place on the base plate 102. As noted above, the projections 208 are configured to move through respective openings 206 in the walls of the port 130. In one embodiment, the openings 206 are aligned with each other along the longitudinal axis 124. Other alignments and configurations for the openings 206 and the projections 208 will be understood by one of skill in the art from the description herein. For example, the pedal 134 may be located behind the handle joint 110 with respect to the longitudinal axis 124, with the projections 208 located in the port 130 at opposite positions along the lateral axis 122. As another example, the pedal 134 and a single projection 208 may be located adjacent one side of a triangular or otherwise shaped top plate 132. Also, the lock member 312 may lie in the same plane as the port 130 and may be positioned above the pivot 300, such as shown in FIGS. 3B and 3C, but other arrangements may be used in other embodiments.

Where the lock member 312 includes multiple protrusions 208 (such as shown), the lock member arms 312' may be joined by a connecting bridge 314 that holds the two arms 312' at the proper position relative to one another and facilitates their simultaneous disengagement. The use of a connecting bridge 314 also may facilitate manufacture and assembly.

The lock member 312 also may include resilient cantilevered flanges 316 that extend to contact respective inner walls 318 of the base plate 102. The flanges 316 are configured to contact the inner walls 318 to press the arms 312' and their respective projections 208 towards the engaged position (i.e., to move the projections 208 into the slots 210). In other embodiments, the flanges 316 may be replaced by other mechanisms, such as separate leaf or coil springs that bias the arms 312' into the engaged position. The flanges 316 also may be omitted. For example, the connecting bridge 314 may act as a leaf spring that biases the two projections 208 towards one another. Other variations and modifications will be apparent to persons of ordinary skill in the art in view of the present disclosure.

When the top plate 132 is housed in the port 130, the projections 208 of the lock member 312 extend through the openings 206 to mate with the slots 210 on the top plate 132, thereby attaching the converted mop 138 to the base plate 102. While the converted mop 138 is attached to the base plate 102, the flanges 316 may remain in contact with the inside walls 318 of the base plate 102, and may be slightly deformed to exert a restoring force on the lock arms 312' to maintain the mated connection between the projections 208 and the slots 210.

To detach the top plate 132 from the port 130 to use the converted mop 138 separately from the base plate 102, the user depresses the pedal 134 downward along the vertical axis 126. As depicted in FIGS. 3B and 3C, depressing the pedal 134 moves the pedal 134 into the cavity 304 and rotates the arm 302 and protrusions 308 about the pivot 300. As the protrusions 300 move, they engage the openings 310 to pull the lock member 312 along the lateral axis 122.

The movement of the lock member 312 along axis 122 pulls the projections 208 out engagement with the slots on the top plate 132. The force applied to the lock member 312 upon depression of the pedal 134 and subsequent rotation of the protrusions 308 about the pivot 300 is sufficient to overcome the biasing force applied to the lock member 312 by the flanges 316. This allows the arms 312' to spread apart until the projections 208 are no longer in the slots 210. The projections 208 may include ramps 320 that abut the edges of the openings 206 to help retract them into the opening 206 as the arms 312' are pulled in the lateral direction 122.

With the pedal depressed to the disengaged position, the projections 208 are moved out of the slots 210, and the user can lift the handle 104 and top plate 132 upward to detach them from the base plate 102. Releasing the pedal 134 allows the spring 306 to expand and push the pedal 134 upwards. This allows the parts to return to the engaged position, with the projections 208 once again extending through the openings 206.

The converted mop 138 may be reattached to the base plate 102 by depressing the pedal 134 to retract the projections 208, and, while keeping the pedal depressed 134, placing the top plate 132 into the port 130. With the top plate 132 in place, the user can release the pedal 134, thereby allowing the projections 208 to reengage with the slots 210. If desired, the slots 210 and/or projections 208 may be configured to allow the top plate 132 to be reattached to the base plate 102 without having to depress the pedal 134. For example, the slots 210 and/or projections 208 may have ramped surfaces that are positioned and oriented to drive the projections 208 into the openings 206 as a force is applied to push the top plate 132 into the port 130. Other suitable reattachment mechanisms will be understood by one of skill in the art from the description herein.

The embodiments described in FIGS. 2-3C are exemplary and not exclusive. Other suitable mechanisms will be understood by one of skill in the art from the description herein. For example, the arm 302 may be moved by actuation of a push rod or linkage, rather than the pedal 134. In another embodiment, the unlocking mechanism may be provided on the top plate 132. For example, the unlocking mechanism may comprise pins located in the slots 210 that are actuated to push the projections 208 out of the slots when it is desired to remove the top plate 132. Of course, the mounting locations and directions of movement of the various parts also may be reoriented or reversed. It is also contemplated that other attachment mechanisms for attaching a converted mop 138 to a base plate 102, such as magnetic attachment, adhesive attachment, snap fitments, and the like, will be suitable according to aspects of the invention, and will be understood by one of skill in the art from the description herein.

Embodiments of the present invention may be used in conjunction with any suitable mop. For example, features as described above may be integrated into existing mop models, either as new designs, or as a retrofit kit. Other embodiments may be combined with features described in co-pending U.S. patent application Ser. Nos. 14/035,431; 14/035,455; and 14/035,472, which are incorporated herein by reference.

The embodiments described herein are all exemplary, and are not intended to limit the scope of the inventions. It will be appreciated that the inventions described herein can be modified and adapted in various and equivalent ways, and all such modifications and adaptations are intended to be included in the scope of this disclosure and the appended claims.

We claim:

1. A mop comprising:

a base plate having a generally flat lower surface configured to face a surface to be cleaned, and an upper surface opposite the lower surface;

a top plate;

a handle having a proximal end, a distal end opposite the proximal end, and a handle axis extending from the proximal end to the distal end;

a joint connecting the proximal end of the handle to the top plate;

a grip located at the distal end of the handle; and a lock assembly configured to selectively connect the top plate to the upper surface of the base plate, the locking assembly comprising:

one or more slots on one of the base plate and the top plate, one or more projections on the other of the base plate and the top plate, the one or more projections being movable between an engaged position in which the one or more projections are in the one or more slots, and a disengaged position in which the one or more projections are not in the one or more slots;

a pedal pivotally mounted on the base plate and operatively connected to the one or more projections and operable to move the one or more projections from the engaged position to the disengaged position; and a spring configured to bias the pedal in an upwards direction away from the upper surface of the base plate.

2. The mop of claim 1, wherein the one or more projections are on the base plate, and the one or more slots are on the top plate.

3. The mop of claim 2, wherein the base plate comprises a port configured to receive the top plate, and the one or more protrusions are located around a perimeter of the port.

4. The mop of claim 1, wherein the top plate comprises a trapezoidal shape.

5. The mop of claim 4, wherein the trapezoidal top plate has a narrow end located on a front side of the handle, and a wide end located on a back side of the handle.

6. The mop of claim 1, wherein the top plate comprises a top plate cleaning pad mounted on a lower surface of the top plate.

7. The mop of claim 1, wherein the base plate comprises a port configured to receive the top plate, and the port comprises a recess that surrounds an entire perimeter of the top plate.

8. The mop of claim 1, wherein the joint comprises a single-axis pivot or a multiple-axis pivot.

9. A mop comprising:

a base plate having a generally flat lower surface configured to face a surface to be cleaned, and an upper surface opposite the lower surface;

a top plate;

a handle having a proximal end, a distal end opposite the proximal end, and a handle axis extending from the proximal end to the distal end;

a joint connecting the proximal end of the handle to the top plate;

a grip located at the distal end of the handle; and a lock assembly configured to selectively connect the top plate to the upper surface of the base plate, the locking assembly comprising:

one or more slots on one of the base plate and the top plate, one or more projections on the other of the base plate and the top plate, the one or more projections being movable between an engaged position in which the one or more projections are in the one or more slots, and a disengaged position in which the one or more projections are not in the one or more slots, a pedal pivotally mounted on the base plate and operatively connected to the one or more projections and operable to move the one or more projections from the engaged position to the disengaged position, and, wherein the one or more projections comprise first and second projections mounted on respective first and second arms, the first and second arms being slidably mounted in the base plate between a first position in which the first and second projections engage corresponding first and second slots on the top plate.

10. The mop of claim 9, wherein the first and second arms are interconnected by a bridge that holds the first and second arms in fixed positions relative to one another.

11. The mop of claim 9, wherein the lock assembly further comprises one or more projections operatively connected to the pedal, the one or more projections being configured to slide the first and second arms along the base plate to move the first and second projections from the engaged position to the disengaged position.

12. The mop of claim 9, wherein the first and second arms are located on opposite sides of the top plate.

13. A mop comprising:

a base plate having a generally flat lower surface configured to face a surface to be cleaned, and an upper surface opposite the lower surface;

a top plate comprising a top plate cleaning pad mounted on a lower surface of the top plate;

a handle having a proximal end, a distal end opposite the proximal end, and a handle axis extending from the proximal end to the distal end;

a joint connecting the proximal end of the handle to the top plate;

a grip located at the distal end of the handle; and a lock assembly configured to selectively connect the top plate to the upper surface of the base plate, the locking assembly comprising:

one or more slots on one of the base plate and the top plate, one or more projections on the other of the base plate and the top plate, the one or more projections being movable between an engaged position in which the one or more projections are in the one or more slots, and a disengaged position in which the one or more projections are not in the one or more slots, and wherein the lock assembly is configured to selectively connect the top plate to the base plate with the top plate cleaning pad located between the top plate and the base plate.

14. The mop of claim 13, wherein the base plate comprises a port configured to receive the top plate, and wherein the port and the top plate comprise matching beveled perimeters.

15. The mop of claim 13, wherein the lock assembly further comprises a pedal operatively connected to the one or more projections and operable to move the one or more projections from the engaged position to the disengaged position.

16. The mop of claim 15, wherein the pedal is pivotally mounted to the base plate.

17. The mop of claim 16, wherein each of the one or more projections is provided on a respective arm, wherein each arm is slidably mounted to the base plate and has an opening configured to receive a protrusion operatively connected with the pedal, such that rotation of the pedal moves the protrusion and engagement between the protrusion and each of the openings slides each of the arms in a lateral direction to move each of the projections from the engaged position to the disengaged position.

18. The mop of claim 17, further comprising a resilient member associated with each arm, and configured to bias each of the arms and each of the projections towards the engaged position.

19. The mop of claim 18, wherein the resilient member comprises a cantilevered flange.

20. The mop of claim 16, further comprising a spring configured to bias the pedal in an upwards direction away from the upper surface of the base plate.

* * * * *